US008833017B1

(12) United States Patent
Huang

(10) Patent No.: US 8,833,017 B1
(45) Date of Patent: Sep. 16, 2014

(54) RAPID HANGING CURTAIN WALL UNIT FOR A WALL ASSEMBLING STRUCTURE

(71) Applicant: Rong-Jun Huang, Taichung (TW)

(72) Inventor: Rong-Jun Huang, Taichung (TW)

( * ) Notice: Subject to any disclaimer, the term of this patent is extended or adjusted under 35 U.S.C. 154(b) by 0 days.

(21) Appl. No.: 14/044,028

(22) Filed: Oct. 2, 2013

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 14/00*** | (2006.01) |
| ***E04B 2/96*** | (2006.01) |

(52) U.S. Cl.
CPC ..... *E04B 2/96* (2013.01)
USPC ..... 52/235; 52/483.1; 52/506.09; 52/510

(58) Field of Classification Search
USPC ..... 52/235, 474, 483.1, 489.1, 489.2, 52/506.06, 506.09, 510, 511, 513
See application file for complete search history.

(56) References Cited

U.S. PATENT DOCUMENTS

| | | | | |
|---|---|---|---|---|
| 3,888,055 | A * | 6/1975 | Gallo | 52/98 |
| 5,060,433 | A * | 10/1991 | Buryan et al. | 52/235 |
| 8,122,650 | B2 * | 2/2012 | Eickhof | 52/134 |
| 2011/0030302 | A1 * | 2/2011 | John J. | 52/489.1 |
| 2012/0186170 | A1 * | 7/2012 | Macdonald et al. | 52/173.3 |
| 2013/0205698 | A1 * | 8/2013 | Todd et al. | 52/302.1 |

* cited by examiner

*Primary Examiner* — Brian Glessner
*Assistant Examiner* — Brian D Mattei
(74) *Attorney, Agent, or Firm* — Rosenberg, Klein & Lee

(57) ABSTRACT

A rapid hanging curtain wall unit for a wall assembling structure includes a wall structure, at least one curtain wall plate, and multiple connecting units. The wall structure has a base and a supporting apparatus mounted in the base. The at least one curtain wall plate has a back surface and multiple positioning holes which are formed in the back surface and separately and horizontally arranged in positions adjacent to an upper edge and a lower edge of the back surface. The multiple connecting units are respectively mounted in the multiple positioning holes. Each one of the at least one curtain wall plate can be hung in the supporting apparatus of the wall structure by the multiple connecting units easily and rapidly.

16 Claims, 4 Drawing Sheets

RAPID HANGING CURTAIN WALL UNIT FOR A WALL ASSEMBLING STRUCTURE

BACKGROUND OF THE INVENTION

1. Field of the Invention

The present invention relates to an assembling component of a wall structure, and more particularly to a rapid hanging curtain wall unit for a wall assembling structure.

2. Description of Related Art

A conventional curtain wall plate is installed on an outside wall of a building for decoration purposes. The curtain wall plate is mostly made of metal, glass, stone veneer or fabric veneer. A conventional installing method of a curtain wall uses multiple anchor bolts for combining a curtain wall plate with a construction wall. The installing method comprises steps of drilling multiple positioning holes in the construction wall and multiple reaming holes in the curtain wall plate, and inserting multiple anchor bolts through the reaming holes to the positioning holes for fixing the curtain wall plate onto the construction wall firmly. When the curtain wall plate is made of stone, the heavy weight of the curtain wall plate causes the anchor bolts to be bent and deformed. In addition, the anchor bolts may be loosened because the curtain wall plate is flaked off around the reaming holes. Thus, the curtain wall plate may fall down easily, hindering the installation or construction.

To overcome the shortcomings of the conventional curtain wall, the present invention provides a rapid hanging curtain wall unit for a wall assembling structure to mitigate or obviate the aforementioned problems.

SUMMARY OF THE INVENTION

The main objective of the invention is to provide a rapid hanging curtain wall unit for a wall assembling structure, the curtain wall unit including a wall structure, at least one curtain wall plate, multiple upper connecting units and multiple lower connecting units.

The wall structure has a base; and a supporting apparatus is mounted on the base and has multiple fixed bars. Each fixed bar has a top surface and a groove formed in the top surface. Each one of the at least one curtain wall plate has a back surface having an upper edge and a lower edge. An upper hole unit is formed and disposed adjacent to the upper edge of the back surface, and the upper hole unit has multiple positioning holes. Each positioning hole has an axis inclined relative to the back surface at an angle. A lower hole unit is formed and disposed adjacent to the lower edge of the back surface, and the lower hole unit has multiple positioning holes. Each positioning hole of the lower hole unit has an axis inclined relative to the back surface at an angle, and the angle of the axis of each positioning hole of the lower hole unit is equal to the axis of the angle of each positioning hole of the upper hole unit.

Multiple upper connecting units are mounted correspondingly in the upper hole unit and each upper connecting unit has a base board that is parallel to the at least one curtain wall plate and has a back side. An inclined pin is mounted on the base board at an angle relative to the base board and equal to the angle of the axis of each positioning hole of the upper hole unit. A hook is formed at the back side of the base board and is hung in the groove of each fixed bar.

Multiple lower connecting units are mounted correspondingly in the lower hole unit and each lower connecting unit has a base board that is parallel to the at least one curtain wall plate and has a bottom. An inclined pin is mounted on the base board at an angle relative to the base board and equal to the angle of the axis of each positioning hole of the lower hole unit. A supporting board protrudes from the bottom of the base board. A screw hole is defined in the supporting board. An adjustable bolt is mounted adjustably in the screw hole of each lower connecting unit and abuts in the groove of each fixed bar that is at a lower position on the base.

Other objects, advantages, and novel features of the invention will become more apparent from the following detailed description when taken in conjunction with the accompanying drawing.

DETAILED DESCRIPTION OF PREFERRED EMBODIMENT

With reference to FIGS. 1 to 4, a rapid hanging curtain wall unit for a wall assembling structure in accordance with the present invention comprises a wall structure 10, multiple curtain wall plates 20, and multiple connecting units 30.

Figure 1:
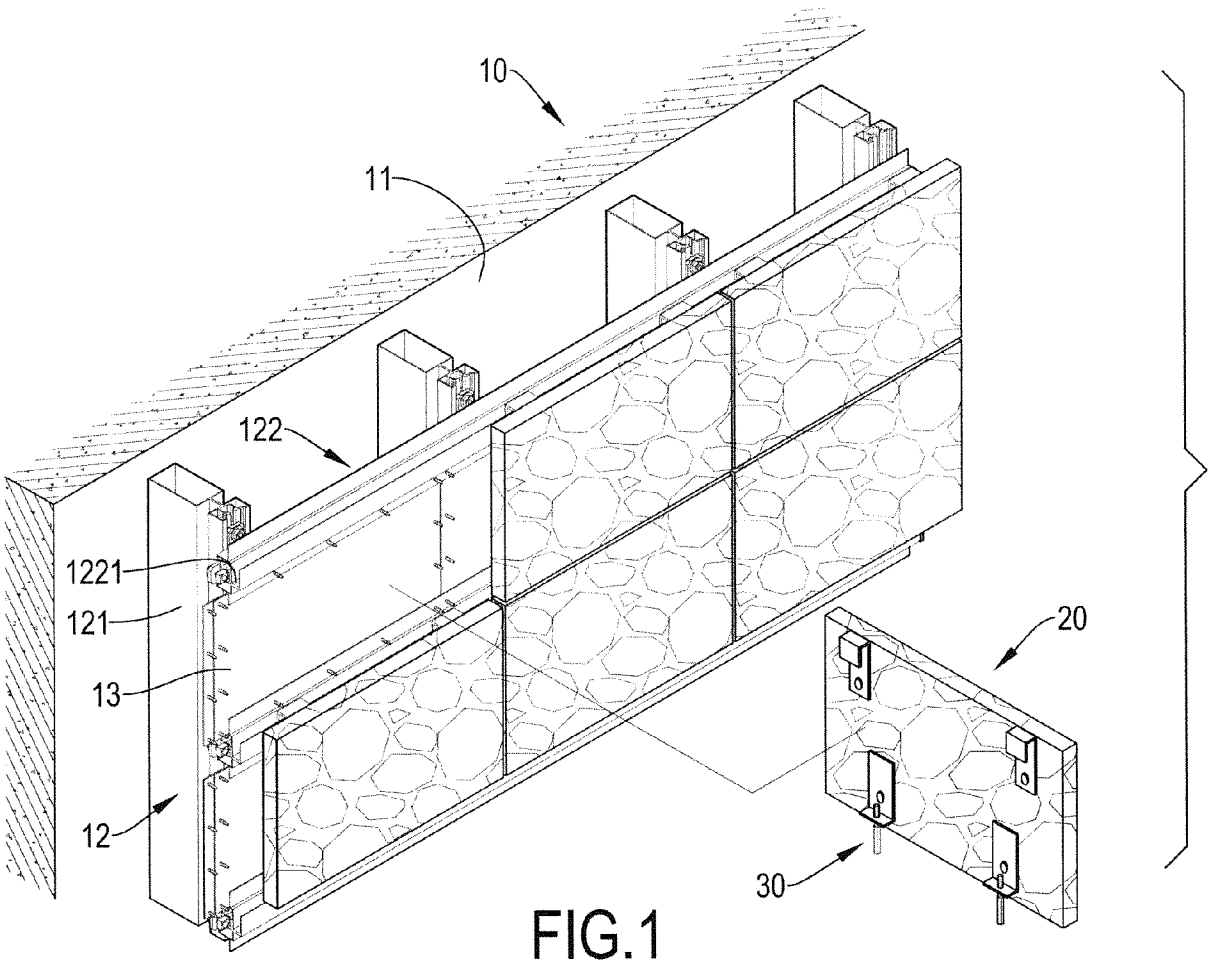
FIG. 1 is an exploded perspective view of a rapid hanging curtain wall unit for a wall assembling structure in accordance with the present invention.

With reference to FIG. 1, the wall structure 10 includes a base 11, a supporting apparatus 12 and multiple waterproof plates 13. The base 11 has a mounting surface. The supporting apparatus 12 includes multiple longitudinal bars 121 and multiple fixed bars 122. The longitudinal bars 121 are arranged at horizontal intervals and are mounted on the mounting surface of the base 11. Each longitudinal bar 121 has an outer side. The fixed bars 122 are mounted on the outer sides of the multiple longitudinal bars 121. The multiple fixed bars 122 are placed horizontally and arranged at longitudinal intervals. Each fixed bar 122 has a top surface and a groove 1221 formed in the top surface of the fixed bar 122. The waterproof plates 13 are mounted in the supporting apparatus 12, are fixed behind the multiple fixed bars 122 and are arranged along the multiple fixed bars 122.

Figure 2:
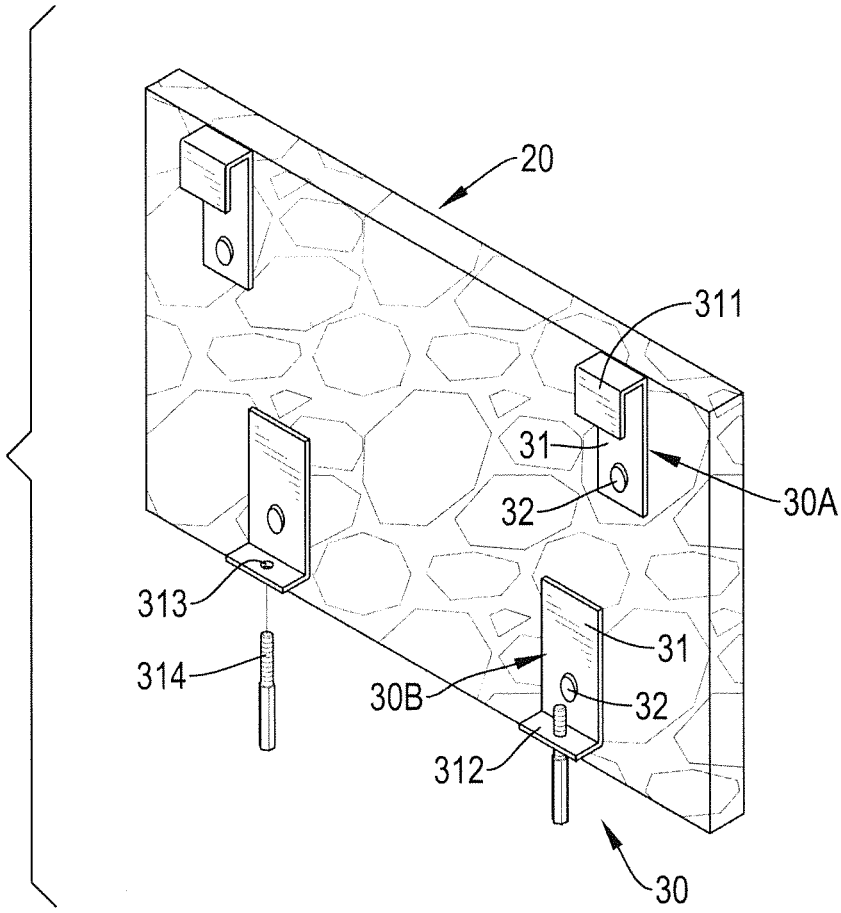
FIG. 2 is an exploded perspective view of the curtain wall plate and multiple connecting units in FIG. 1.
Figure 3:
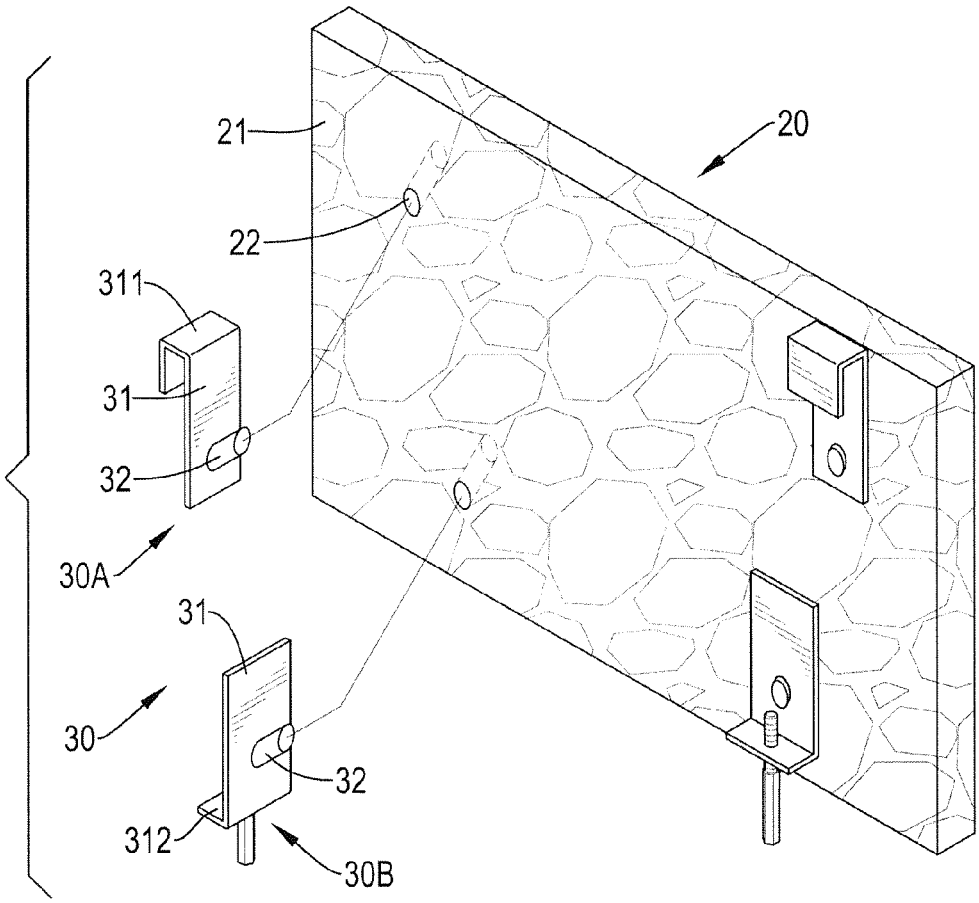
FIG. 3 is an exploded perspective view of the curtain wall plate and multiple connecting units in FIG. 2.

With reference to FIGS. 2 and 3, the curtain wall plates 20 may be made of metal, stone or fabric veneer. Preferably, the curtain wall plates 20 are made of stone. Each curtain wall plate 20 has a back surface 21. The back surface 21 has an upper edge and a lower edge.

Figure 4:
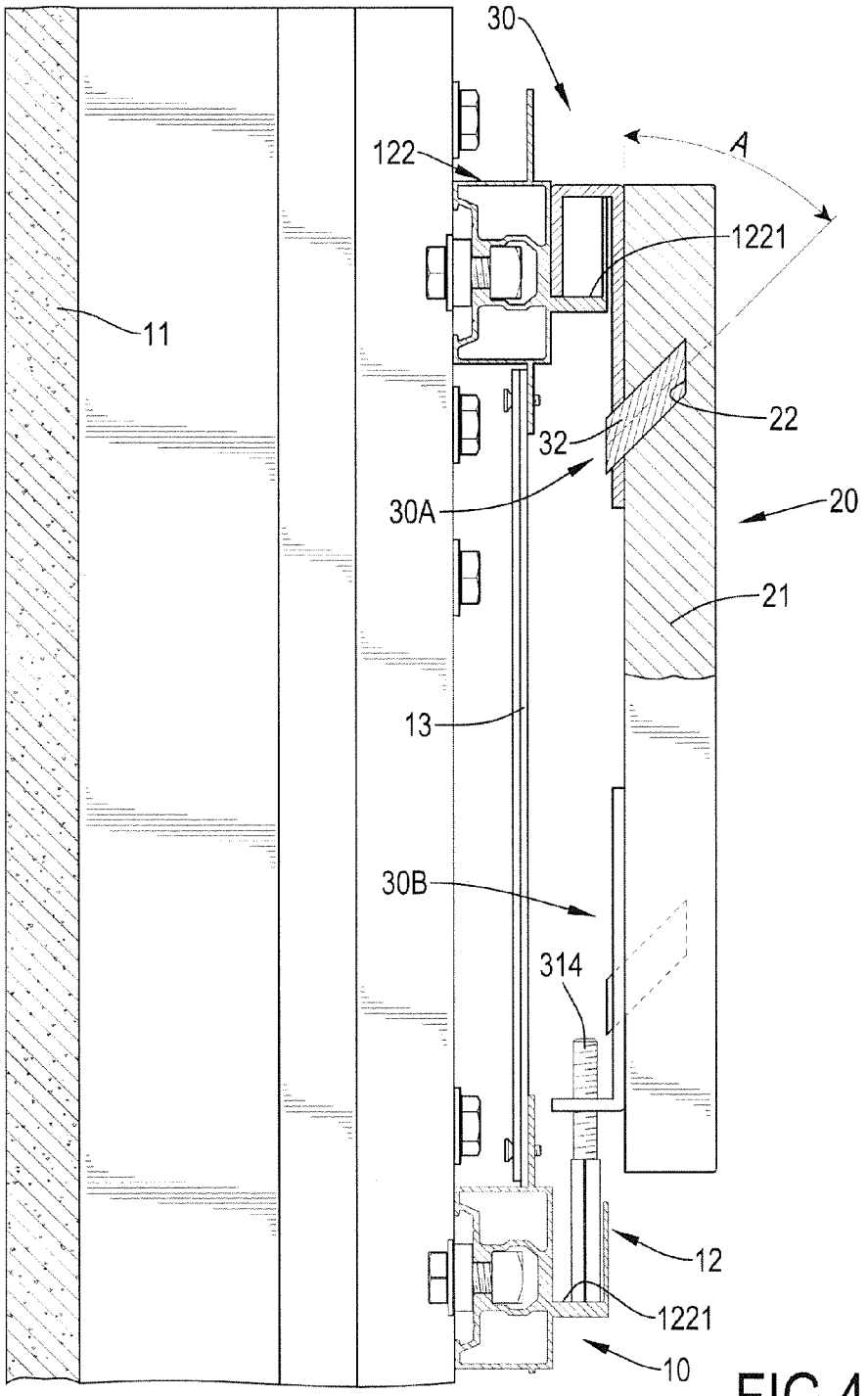
FIG. 4 is a side view in partial section of the rapid hanging curtain wall unit for a wall assembling structure in FIG. 1.

With reference to FIGS. 3 and 4, multiple positioning holes 22 are formed in the back surface 21 of the curtain wall plate 20 and are separately arranged horizontally in positions respectively adjacent to the upper edge and the lower edge of the back surface 21. Each positioning hole 22 has an axis that is inclined relative to the back surface 21, such that an angle A is defined between the axis of each positioning hole 22 and the back surface 21. The angle A ranges from 30 degrees to 60 degrees. The angles A of the multiple positioning holes are equal.

The positioning holes 22 are divided into an upper hole unit 22A and a lower hole unit 22B. The upper hole unit 22A is disposed adjacent to the upper edge of the back surface 21. The lower hole unit 22B is disposed adjacent to the lower edge of the back surface 21. Preferably, the upper hole unit 22A and the lower hole unit 22B each respectively include two positioning holes 22. A distance between the two positioning holes 22 of the upper hole unit 22A is longer than a distance between the two positioning holes 22 of the lower hole unit 22B.

With reference to FIGS. 2 and 3, each connecting unit 30,30A,30B includes a base board 31 and an inclined pin 32. The base board 31 is parallel to the curtain wall plates 20 and has a back side. The inclined pin 32 is mounted on the base board 31 opposite the back side and at an angle relative to the base board 31 and equal to each of the angles A of the positioning holes 22. The multiple connecting units 30 are divided into multiple upper connecting units 30A and multiple lower connecting units 30B. The upper connecting units 30A are inserted into the upper hole unit 22A. A hook 311 that is bent is formed at the back side of the base board 31 of each upper connecting unit 30. The lower connecting units 30B are inserted into the lower hole unit 22B. A supporting board 312 protrudes from the bottom of the base board 31 of each lower connecting unit 30B. A screw hole 313 is defined through the supporting board 312. An adjustable bolt 314 is screwed adjustably in the screw hole 313 of each lower connecting unit 30B.

Preferably, an outer surface of each inclined pin 32 is coated with glue. Each glue-coated inclined pin 32 is inserted into a corresponding positioning hole 22 for firmly connecting the multiple connecting units 30 with the back surface 21 of the curtain wall plates 20.

With reference to FIGS. 1 and 4, each curtain wall plate 20 is hung on the supporting apparatus 12 of the wall structure 10. Each curtain wall plate 20 is hung in the grooves 1221 of the fixed bars 122 that are positioned at an upper position on the base 11 by the hooks 311 of the upper connecting units 30A. Each adjustable bolt 314 abuts in the grooves 1221 of the fixed bars 122 which are positioned at a lower position on the base 11 for dispersing the weight of the curtain wall plates to the fixed bars 122.

The inclined pins 32 on the connecting units 30,30A,30B support the weights of the curtain wall plates. As the inclined pins 32 extend with an upward inclination, the inclined pins 32 would not be easily inclined downward by the weight of the curtain wall plates. The multiple curtain wall plates 20 are installed and positioned easily and rapidly on the wall structure 10 and would not wobble easily by shaking. In addition, the curtain wall plates 20 can be hung on the supporting apparatus 12 without using anchor bolts. Even after a long time of use, the inclined pins 32 of the multiple connecting units 30 can resist bending or deformation and are still able to support the curtain wall plates 20.

The present invention may utilize either one curtain wall plate 20 or multiple curtain wall plates 20 hung on the wall structure 10. Besides stone, the material of the curtain wall plates 20 may be chosen from metal, glass, wood or fabric veneer.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A rapid hanging curtain wall unit comprising:

a wall structure having a base; and a supporting apparatus mounted on the base and having multiple fixed bars, each fixed bar having a top surface and a groove formed in the top surface;

at least one curtain wall plate, each one of the at least one curtain wall plate having a back surface having an upper edge and a lower edge;

an upper hole unit formed and disposed adjacent to the upper edge of the back surface, and having multiple positioning holes, each positioning hole having an axis inclined relative to the back surface at an angle;

a lower hole unit formed and disposed adjacent to the lower edge of the back surface, and having multiple positioning holes, each positioning hole of the lower hole unit having an axis inclined relative to the back surface at an angle, the angle of the axis of each positioning hole of the lower hole unit being equal to the angle of the axis of each positioning hole of the upper hole unit;

multiple upper connecting units mounted correspondingly in the upper hole unit, and each upper connecting unit having a base board being parallel to the at least one curtain wall plate and having a back side;

an inclined pin mounted on the base board at an angle relative to the base board and equal to the angle of the axis of each positioning hole of the upper hole unit; and a hook formed at the back side of the base board and hung in the groove of each fixed bar;

multiple lower connecting units mounted correspondingly in the lower hole unit, and each lower connecting unit having a base board being parallel to the at least one curtain wall plate and having a bottom;

an inclined pin mounted on the base board at an angle relative to the base board and equal to the angle of the axis of each positioning hole of the lower hole unit; and a supporting board protruding from the bottom of the base board of the lower connecting unit;

a screw hole defined in the supporting board;

an adjustable bolt mounted adjustably in the screw hole of each lower connecting unit and abutting in the groove of each fixed bar that is at a lower position on the base.

2. The rapid hanging curtain wall unit as claimed in claim 1, wherein the angles of the axes of the multiple positioning holes are equal and each of the angles ranges from 30 degrees to 60 degrees.

3. The rapid hanging curtain wall unit as claimed in claim 2, wherein the upper hole unit and the lower hole unit each respectively have two positioning holes.

4. The rapid hanging curtain wall unit for a wall assembling structure as claimed in claim 3, wherein a distance between the two positioning holes of the upper hole unit is longer than a distance between the two positioning holes of the lower hole unit.

5. The rapid hanging curtain wall unit for a wall assembling structure as claimed in claim 1, wherein the at least one curtain wall plate is made of stone.

6. The rapid hanging curtain wall unit for a wall assembling structure as claimed in claim 2, wherein the at least one curtain wall plate is made of stone.

7. The rapid hanging curtain wall unit for a wall assembling structure as claimed in claim 3, wherein the at least one curtain wall plate is made of stone.

8. The rapid hanging curtain wall unit for a wall assembling structure as claimed in claim 4, wherein the at least one curtain wall plate is made of stone.

9. The rapid hanging curtain wall unit for a wall assembling structure as claimed in claim 5, wherein the supporting apparatus further includes multiple longitudinal bars arranged at horizontal intervals and mounted on the base of the wall structure.

10. The rapid hanging curtain wall unit for a wall assembling structure as claimed in claim 6, wherein the supporting apparatus further includes multiple longitudinal bars arranged at horizontal intervals and mounted on the base of the wall structure.

11. The rapid hanging curtain wall unit for a wall assembling structure as claimed in claim 7, wherein the supporting apparatus further includes multiple longitudinal bars arranged at horizontal intervals and mounted on the base of the wall structure.

12. The rapid hanging curtain wall unit for a wall assembling structure as claimed in claim 8, wherein the supporting apparatus further includes multiple longitudinal bars arranged at horizontal intervals and mounted on the base of the wall structure.

13. The rapid hanging curtain wall unit for a wall assembling structure as claimed in claim 9, wherein the wall structure further includes multiple waterproof plates mounted in the supporting apparatus and fixed behind the multiple fixed bars and arranged along the multiple fixed bars.

14. The rapid hanging curtain wall unit for a wall assembling structure as claimed in claim 10, wherein the wall structure further includes multiple waterproof plates mounted in the supporting apparatus and fixed behind the multiple fixed bars and arranged along the multiple fixed bars.

15. The rapid hanging curtain wall unit for a wall assembling structure as claimed in claim 11, wherein the wall structure further includes multiple waterproof plates mounted in the supporting apparatus and fixed behind the multiple fixed bars and arranged along the multiple fixed bars.

16. The rapid hanging curtain wall unit for a wall assembling structure as claimed in claim 12, wherein the wall structure further includes multiple waterproof plates mounted in the supporting apparatus and fixed behind the multiple fixed bars and arranged along the multiple fixed bars.

* * * * *